United States Patent [19]

Rice

[11] 3,941,076

[45] Mar. 2, 1976

[54] OPERATING MEANS FOR BOATS

[76] Inventor: Robert D. Rice, 380 Murphy Creek Road, Grants Pass, Oreg. 97526

[22] Filed: Oct. 22, 1974

[21] Appl. No.: 516,981

[52] U.S. Cl. ..... 115/12 R; 114/151

[51] Int. Cl.[2] ..... B63H 11/08

[58] Field of Search ..... 115/11, 12 R, 14–16, 115/17, 18 R, 18 A, 70; 114/151, 184; 60/221, 222

[56] References Cited

UNITED STATES PATENTS

| | | | |
|---|---|---|---|
| 2,363,335 | 11/1944 | Katcher et al. | 114/151 |
| 2,718,206 | 9/1955 | Camp | 115/17 |
| 3,127,477 | 5/1964 | Egger | 115/12 R |
| 3,613,630 | 10/1971 | Jacuzzi | 114/184 |
| 3,835,806 | 9/1974 | Rice | 115/12 R |

*Primary Examiner*—Trygve M. Blix
*Assistant Examiner*—Jesus D. Sotelo
*Attorney, Agent, or Firm*—Clarence M. Crews

[57] ABSTRACT

A motor driven pump, located substantially at the center of mass of a boat and its fixed contents, is provided with a series of selectively effective, aligned openings for taking in water from a selected direction and discharging it in the same direction, so that the boat can be shifted at will forward, backward, sidewise or obliquely without substantially affecting the orientation of the keel of the boat. Provision is made for the utilization of the same pump (1) for pumping out and discharging bilge water; (2) for utilizing water from the body of water in which the boat floats to fight fires; and (3) for turning the boat through simultaneous utilization of disaligned intake and discharge passages. Provision is further made for the optional use of an auxiliary boat driving motor in the stern of the boat with slide member for smoothly covering and streamlining the auxiliary motor operating space when such motor is withdrawn therefrom.

9 Claims, 13 Drawing Figures

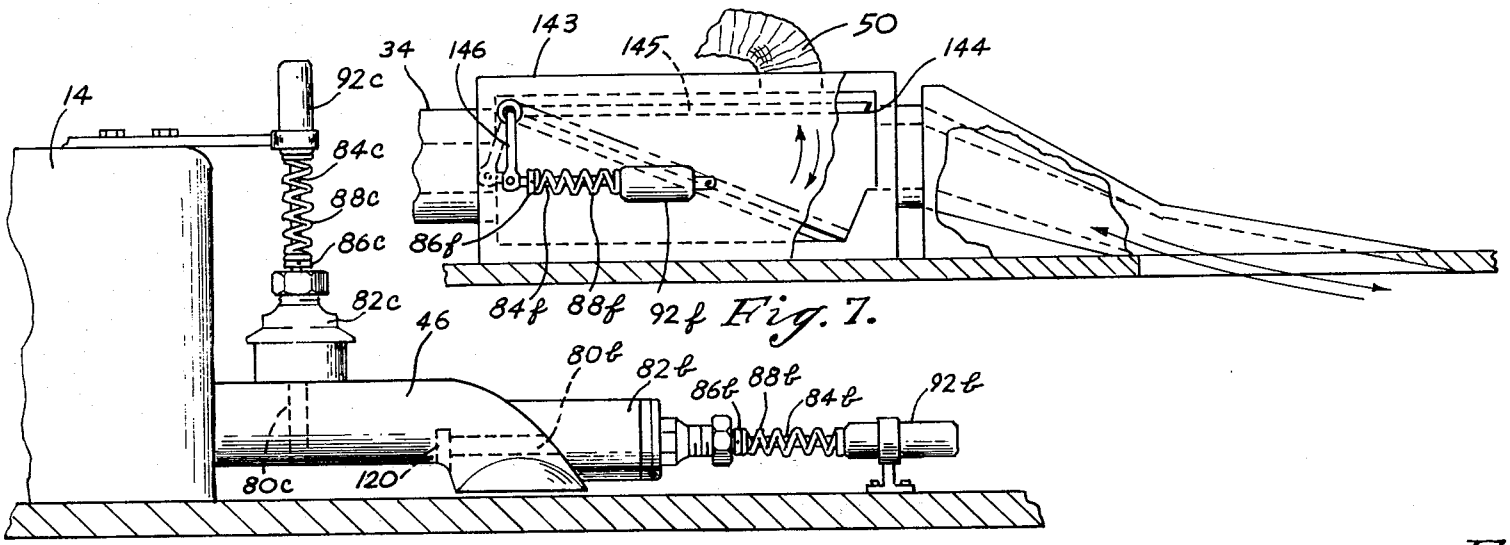
Fig. 7.
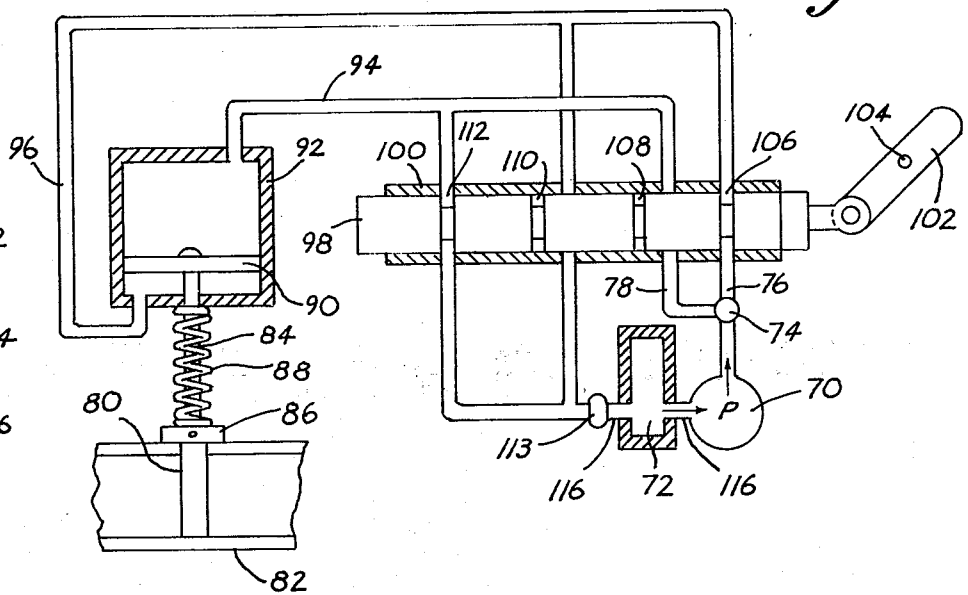
Fig. 9.
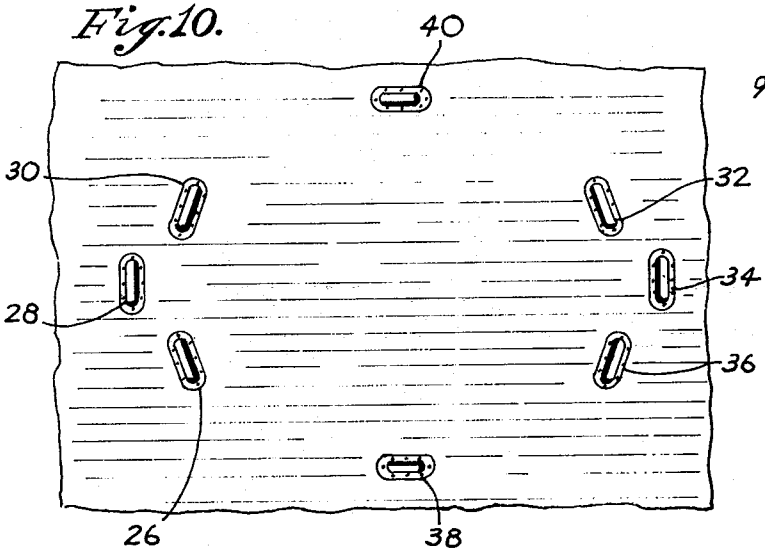
Fig. 8.
Fig. 10.

OPERATING MEANS FOR BOATS

This invention relates to operating means for boats and is in the nature of an improvement upon the invention disclosed and claimed in my U.S. Pat. No. 3,835,806 of Sept. 17, 1974, for Power Propulsion Means for Boats.

As in said patent, a motor driven pump located substantially at the center of gravity of the boat and its fixed contents, is provided with a series of selectively effective, aligned openings for taking in water in a selected direction and discharging it in the same direction, whereby the boat can be shifted at will forward, backward, to either side or obliquely without substantially affecting the orientation of the keel of the boat.

In accordance with the present invention all the advantages of the patented construction are made available but significant advances are also realized.

It is a feature that the same pump normally utilized for the propulsion of the boat is also utilized for pumping out bilge water.

It is a further feature that the same pump is arranged to utilize disaligned intake and discharge openings for reorientation of the boat.

It is a still further feature that the same pump is utilized for withdrawing water from the body of water in which the boat floats and discharging it for fighting a fire either on the boat itself, on shore, or on a nearby boat.

It is also a feature that provision is made for the utilization of an auxiliary outboard motor unit in a space provided in the stern of the boat with means for covering and streamlining the auxiliary motor operating space when the auxiliary motor is withdrawn from its operative position.

Other objects and advantages will hereinafter appear.

In the drawing forming part of this specification:

FIG. 7 is a fragmentary view in side elevation, partly in section and partly broken away, of the outlet directly to the rear which serves also as the bilge discharge;

FIG. 8 is a fragmentary vertical sectional view showing particularly the bilge water intake;

FIG. 9 is a plan view, more or less diagrammatic, showing a typical valve control organization which is used, substantially as shown, for controlling pump inputs and outputs;

FIG. 10 is a fragmentary plan view showing the front, rear and side intake and discharge water openings for controlling movements of the boat with and without reorientation of the keel;

Figure 1:
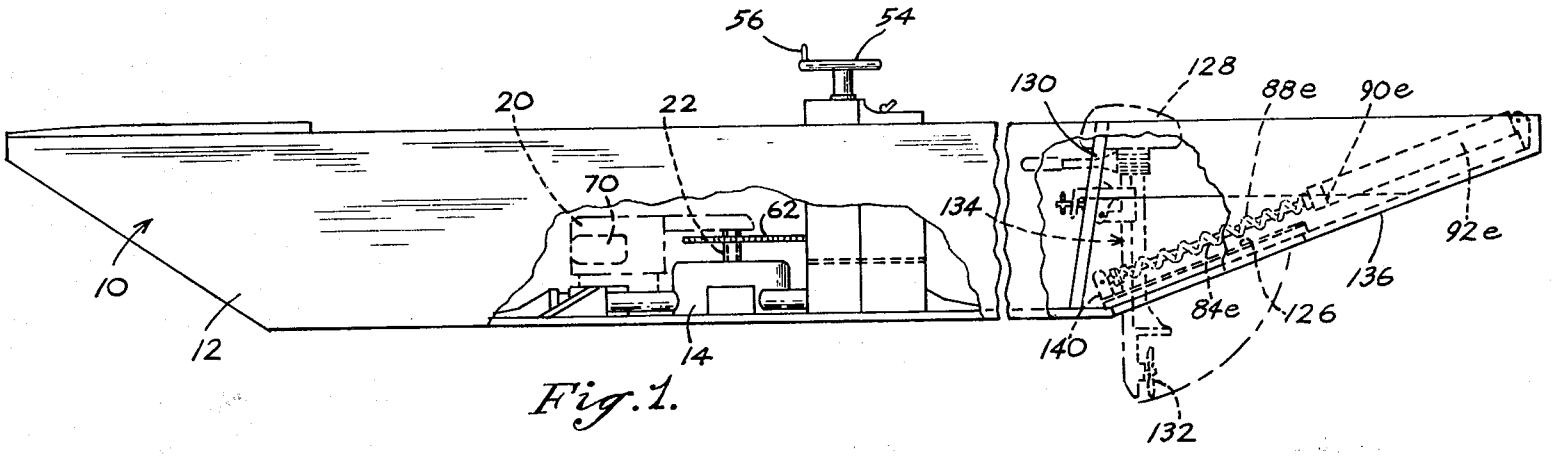
FIG. 1 is a view in side elevation, partly broken away from compactness of illustration and for exposing certain details, of a boat embodying features of the invention.
Figure 2:
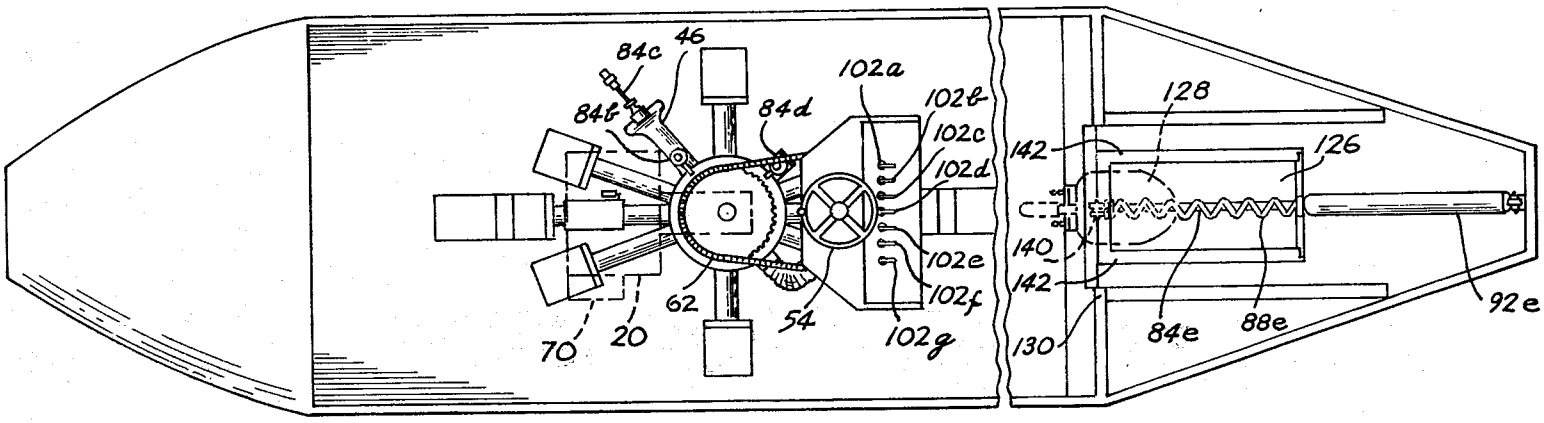
FIG. 2 is a plan view of the novel boat broken away similarly to FIG. 1 for compactness of illustration.

As in the case of my patented boat, the present boat 10 has a hull 12 of generally conventional configuration. Oar locks and one or more seats may be provided but are not shown. At or near what is calculated to be the approximate center of gravity of the boat and the fixed contents thereof, a hollow cylindrical shell 14, open at the top, is rigidly affixed to the boat bottom. The shell 14 forms a seat for a hydraulic pump 16.

A pump casing 18 fits in the shell 14 and is supported snugly in the shell with freedom for unlimited rotative adjustment relative to the shell.

An internal combustion engine 20 is mounted in front of the pump and has a chain-driven output shaft 22 which extends vertically downward and is concentric with shell 14 and pump casing 18. Since the engine may be of conventional design, the structure of the engine and its controls are not shown in detail.

The output shaft 22 of the engine extends downward through the center of the pump and has affixed to it suitable impeller blades 24 which are properly sloped to drive water in the pump chamber upward. The blades may desirably be disposed in overlapping relation. The pump chamber is desirably placed so low in the boat that it is below water level for at least a substantial portion of its depth, so that water will normally stand in the chamber at least partway up the impeller blades when the pump is idle, and will flow by hydrostatic pressure into the pump chamber to replace expelled water when the pump is in action. This is desirable for keeping the pump primed. So long as the pump is primed, the rotating impeller blades will act to draw water from the boat sustaining body of water into the pump chamber.

For supplying water to the intake or lower end of the pump, and for carrying it away from the discharge or upper end, provision is made of a series of fixed radiating conduits or passages, generally similar to the arrangement of my issued patent but differing significantly therefrom.

In the patent, for every rotary setting of the casing corresponding to 18 hereof which provided one or more active inlets, there was invariably provided for each active inlet an aligned active output. This arrangement is significantly modified in the present instance, as clearly revealed in FIGS. 11 and 12 hereof.

As in the patented structure, the shell 14 includes three fixed forward passages 26, 28 and 30 which are adapted to serve as inlets or outlets, and three rear passages 32, 34 and 36 which are adapted to serve as outlets or inlets, the passages 32, 34 and 36 being aligned, respectively, with passages 26, 28 and 30. As in the patent the shell 14 also provides a lateral passage 38 which is aligned with a lateral passage 40.

In the present instance, however, instead of making the pump casing have two opposed channel sectors of equal width and each wide enough to render 26, 28 and 30, or 32, 34 and 36 simultaneously active, one sector passage 42 of that width and an opposed narrow sector passage 44 centered on the same diametrical line as 42 are provided.

With this kind of arrangement the lateral passages 38 and 40 function as before, but the narrowing of 44 introduces the possibility of rendering 32 active simultaneously with 26 and 28; and 34 which extends directly rearward from the pump active simultaneously with 26, 28 and 30; and 36 active simultaneously with 28 and 30. The second of these combinations would drive the boat straight ahead. The first would reorient the boat in one direction, and the third would reorient it in the opposite direction. Similar results, but with the boat moving backward, would occur if 44 were turned into association with 26, 28 and 30.

Figure 4:
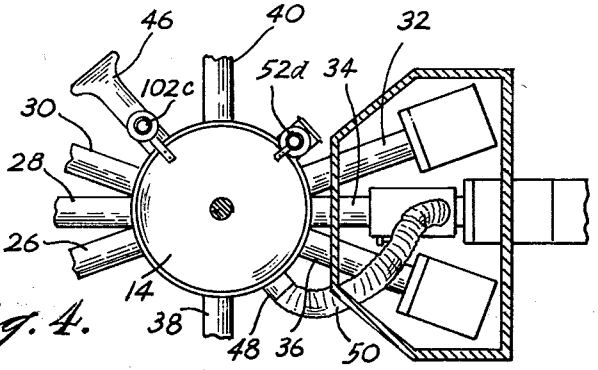
FIG. 4 is a fragmentary plan view of the principal pump and all of the immediate connections thereof.
Figure 12:
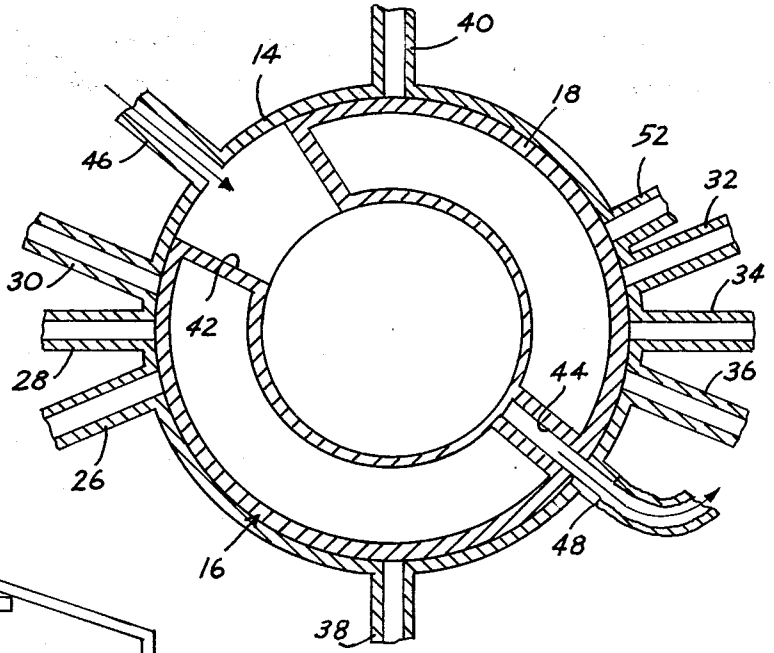
FIG. 12 is a view similar to FIG. 11 but showing the setting for bilge water pumping.

In addition to the passages thus far referred to, intake pasage 42 may be aligned with a bilge water intake passage 46 at the same time that output passage 44 is aligned with a bilge water output passage 48. (See FIG. 12) The passage 48 discharges through a hose 50 or other suitable means into passage 34 for disposing of the bilge water, as best seen in FIG. 4. The setting for bilge pumping is illustrated in FIG. 12.

Provision is made for rendering bilge intake passage 46 normally inactive, as will be explained presently, so that the intake of bilge water need never interfere with the operation of the boat under normal circumstances. The passage 46 can, however, be rendered active at the will of the operator in conjunction with the setting of FIG. 12.

Provision is also made for storing a quantity of water in a portion of passage 46 and releasing it to the pump when bilge water pumping is initiated, in order to assure a bilge water prime for the pump.

Figure 11:
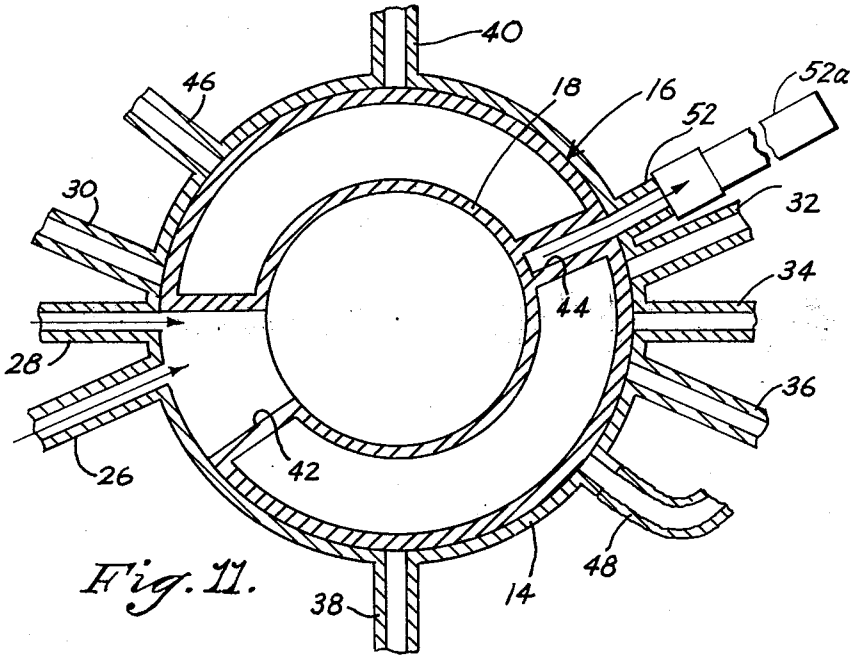
FIG. 11 is a fragmentary horizontal plan view showing the setting of the pump housing for fire-fighting purposes.

Provision is also made for fighting fires by drawing water from the boat supporting body of water and for projecting it in a stream to a fire on the boat itself, on another boat, or on shore. The setting of 18 for this purpose is shown in FIG. 11. The intake passage 42 is set to receive water from passages 26 and 28 while discharge passage 44 is aligned with a fire discharge passage 52. The fire discharge 52, when active, delivers to a short length of flexible hose 52*a* so that the discharged stream may be directed toward the fire.

Again, provision is made of a valve 52*d* for normally choking off the delivery of water through 52 so long as there is no fire to fight as will be explained.

Figure 3:
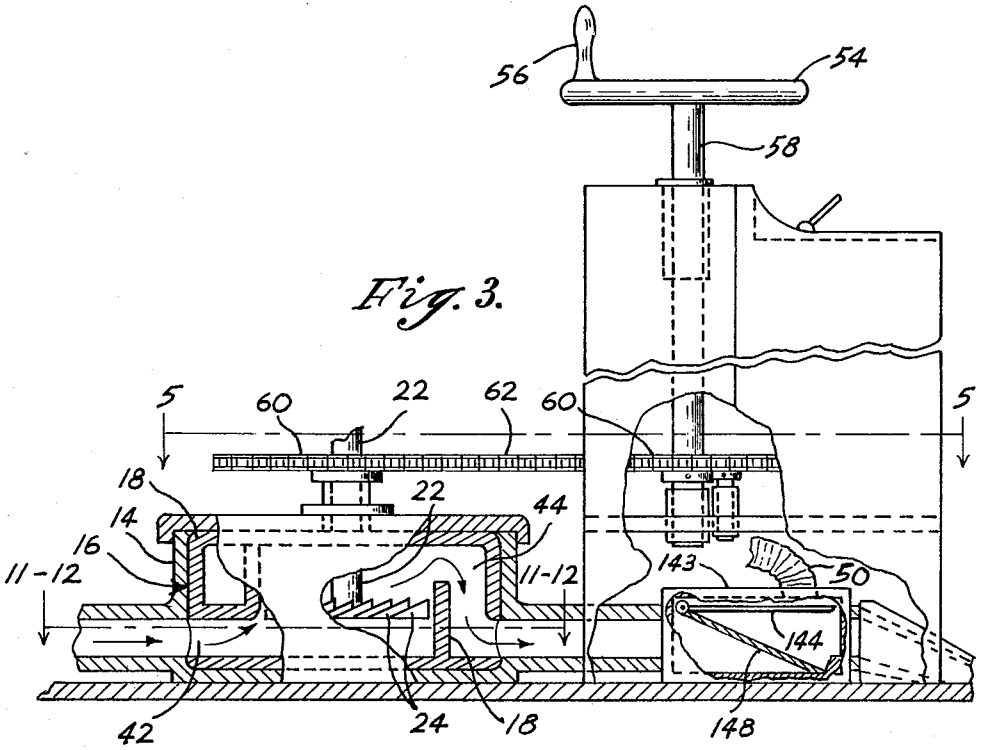
FIG. 3 is a fragmentary view in side elevation, partly broken away, showing the water pump, certain pump connections and the principal control means of said pump.
Figure 5:
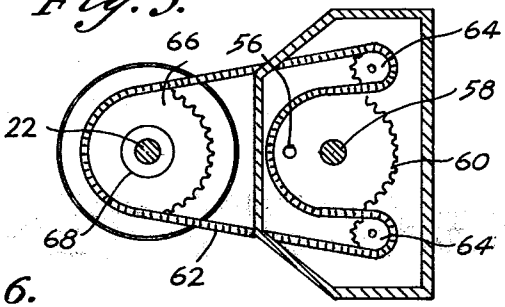
FIG. 5 is a horizontal sectional view as seen from above of control means for the principal pump, the section being taken on the line 5—5 of FIG. 3, looking in the direction of the arrows.
Figure 6:
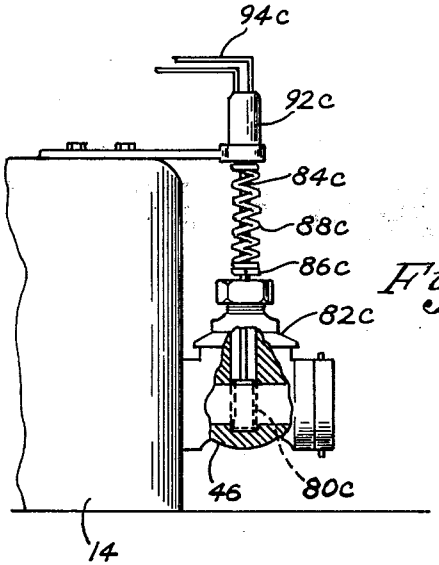
FIG. 6 is a fragmentary detail view in elevation, partly broken away, showing a typical hydraulically controlled valve.

The various settings of the pump casing 18 are controlled by the pilot from a wheel 54 having an upstanding handle 56. The wheel 54 is fast on the upper end of a vertical shaft 58 (FIGS. 3 and 5). The shaft 58 has fast upon it a gear or sprocket 60 which drives and controls a chain 62. The chain 62 is trained, as best seen in FIG. 5, about the sprocket 60, about idler side sprockets 64 and about a sprocket or gear 66 fast on a sleeve 68 which surrounds the drive shaft 22 of the pump 16 and is of the same diameter as gear 60.

It will be seen that operation of the wheel 54 can adjust the setting of the pump casing 18:

1. To drive the boat forward, backward, sidewise or diagonally without reorientation of the boat's keel;
2. To steer the boat by reorientation of the boat's keel;
3. To pump bilge water out of the boat; and
4. To fight fires.

Some of these capabilities are inconsistent or conflicting with others. It is important, therefore, that provision be made for avoiding objectionable conflicts. To this end, means are provided for optionally rendering certain intake and/or discharge passages normally inactive but active as specifically required.

For this purpose, a hydraulic system employing oil as the active liquid is utilized. This system includes an auxiliary pump 70, driven by the engine 20, but arranged to shut off automatically whenever a predetermined maximum pressure is attained.

The pump 70, when active, draws oil from a reservoir 72 which is not under pressure. The pump 70 supplies oil under maximum pressure to a manifold line 74 from which several lines 76 and several lines 78 branch off.

As seen in FIG. 9, the controlled water valve, of which the illustrated valve 80 is typical, is projected into and withdrawn from a water passage on a conduit like 82. The valve 80 is desirably rectangular in form. The conduit 82 may be rectangular in cross-section, or it may contain parallel plates which have aligned openings adapted to be covered and uncovered by the valve without leakage. The stem 84 of valve 80 is provided with a fixed collar 86 which is constantly urged by a compression coil spring 88 in a direction to close the valve. The spring 88 surrounds the valve stem 84. The valve stem 84 has affixed to its upper end a piston 90 which fits the bore of a cylinder 92. The piston 90 divides the cylinder into upper end lower chambers of variable, complementary volumes. A conduit 94 constantly communicates with the upper chamber of 92 while a conduit 96 constantly communicates with the lower chamber of 92.

As shown, a cylindrical slide valve 98, operable in a fixed sleeve 100 and controlled in its setting by a lever 102 which is manually operable about a fixed pivot 104, connects the output side of the pump 70, through 76 and 96, with the lower chamber of cylinder 92, so that the piston 90 is being driven upward.

The valve 98 is desirably a solid cylinder having four circumferential channels 106, 108, 110 and 112 formed in it.

As shown in FIG. 9, the valve 98 connects the upper chamber of cylinder 92 through the conduit 94 and channel 112 with a comprehensive conduit 113 which delivers to the reservoir or sump 72. The reservoir 72, in turn, is connected through conduit 116 with the intake side of pump 70.

When it is desired to close the valve 80, the operating instrumentalities of valve 80 are reversed by shifting the valve 98 to place 96 through channel 110 in communciation with reservoir 72 and the intake side of pump 70, and to place 94, through channel 108, in communication with the output side of the pump 70.

It is not essential to keep the piston 90 at an end of the cylinder 92. The piston 90, and therefore the valve 80, may be maintained in any desired intermediate position by setting the valve 98 to render and maintain all of passages 106, 108, 110 and 112 simultaneously inactive.

Figure 13:
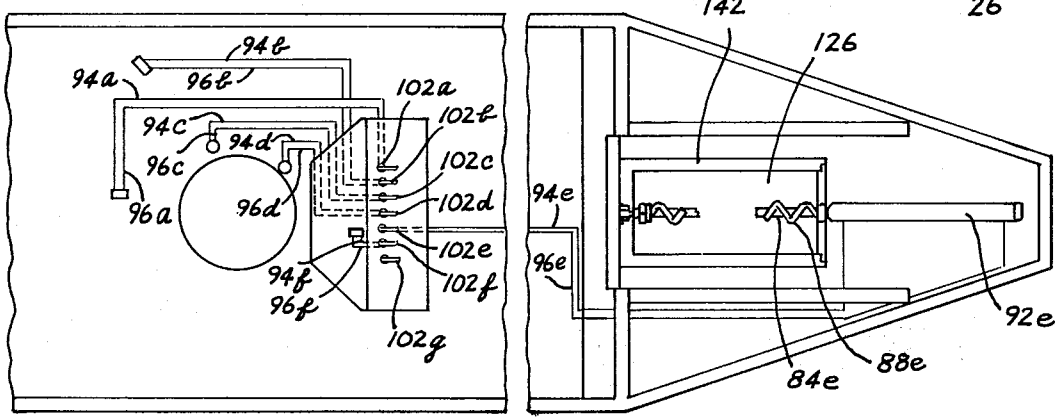
FIG. 13 is a fragmentary, more or less diagrammatic plan view, showing a hydraulic control system for various intake and discharge passages.

As shown in FIG. 13, the several operating levers 102*a*, 102*b*, 102*c*, 102*d*, 102*e*, 102*f*, and 102*g* are arranged to form a control console conveniently accessible to the pilot. In this figure conduits 94*a* and 96*a*, 94*b* and 96*b*, etc., are represented diagrammatically by single lines.

The reference characters employed in the description of FIG. 9 will be used with the subscript *a* added in connection with the front intake control, with *b* added in connection with a first bilge water intake valve, with *c* added in connection with a second bilge water intake valve, with *d* added in connection with a fire fighting valve, with *e* added in connection with a rear sliding door for closing the operating space of an optionally usable auxiliary outboard motor, and with *f* added in connection with the valve in rear center passage 34. Subscript *g* is added in connection with a spare console lever 102*g*. Not all of these reference characters appear on the drawing, but the structure and operation can be readily understood by referring to FIG. 9.

Some of the water valve operating means differ in minor details from FIG. 9. These differences will be referred to as the description of each proceeds.

Before going further into fire-fighting or bilge water pumping an analysis of available settings for turning the boat and/or for driving the boat without turning is in order.

Speed is, of course, primarily responsive to throttle control of motor 20.

When 44 delivers into 34 the intake will be through 26, 28 and 30 and the boat will move directly forward.

When 44 delivers into 32 the intake will be through 26, 28 and 30 and the boat will turn clockwise while moving forward.

When 44 delivers into 36 the intake will be through 30 and the boat will move forward diagonally without turning.

When the fire-fighting setup of FIG. 11 is established the boat will tend to move backward while turning clockwise, but if the fire-fighting hose is pointed between 28 and 26 the boat will remain stationary. This would be desirable if the fire is on shore. If the fire is on another boat which is drifting downstream the pointing of the hose and the orientation of the boat can be adjusted to cause this boat to drift downstream also. If the boat is not aground or anchored, a reversible outboard motor unit 128 may be used to advantage for offsetting the tendency of fire-fighting water intake and discharge to move the boat.

If the bilge is being pumped, the bilge intake has no tendency to move the boat, but the discharge stream tends to drive the boat forward because the discharge is through the outlet 34, directly astern. This is a very desirable arrangement because the discharge of the bilge water through 34 tends to drive the boat straight ahead and it may be important to get the boat safely docked or grounded.

The need for pumping bilge water may arise simply through slow seepage. In this case the boat may be anchored during pumping. If not anchored, its movement may be of small concern. If, however, the water is pouring into the hull of the boat because the hull has been damaged, the incidental driving of the boat toward shore or toward a dock may be imperative. Discharge of bilge water through 34 tends to drive the boat straight forward although the location of a substantial leak may have a modifying effect.

The effect produced by operation of the lever 102a will be to raise or lower a piston 90*a* which controls the front central intake 28. With front intake 28 shut off, front intake from the boat sustaining body of water can only be through 26 and 30, or through 26 or through 30. It is still possible to drive the boat directly forward or to turn it right or left. The reason for providing a water valve in the front, center passage 28 is primarily to set the valve 80*a* in a partially open position for controlling trawling speed without throttling the motor 20.

Two water valves are provided at the intake end of the bilge line as seen in FIG. 8. The purpose of this is to provide and maintain between the closed valves a body of water adequate to provide a prime when bilge water pumping is initiated.

The bilge intake line 46 extends horizontally throughout most of its length, but is turned downward at its rear extremity to clear the boat bottom by a slight amount.

The valve 80*b* is located in the downturned end of 46 and is disposed horizontally as is the operating mechanism for the valve. When fully closed the rear end of the valve 80*b* bears against a fixed, upstanding abutment or shoulder 120.

The valve 80*c*, on the other hand, is disposed vertically and when both 80*b* and 80*c* are fully closed the space between them is completely sealed off, and a substantial body of water can be stored in that space. This provides for a priming of the pump 16 relative to the bilge, if that is required, upon the initiation of bilge water pumping.

For pumping water into the bilge water intake line 46 the discharge passage 44 is turned into alignment with 46, the valve 80*b* is held closed and the valve 80*c* is completely opened. This places the inlet passage 42 in communication with 48 and through hose 50 with 34 which is normally the rear center discharge line. The line 48 terminates below water level. Water is drawn in through 48 until 46 is completely filled. The valve 80*c* is then operated to its fully closed position, trapping the water between itself and the closed valve 80*b*.

Any intake through 26 or 30 with 18 in the position of FIG. 11 when there is no fire to be fought would cause a useless discharge of water through the fire outlet 52. The fire outlet is accordingly provided with a valve 52d (FIG. 4) which is normally closed.

The lever 102*e*, through a valve 98*e* and lines 94e and 96*e*, controls not a water valve, but a slide 126 at the extreme rear end of the boat.

An auxiliary outboard motor 128 is pivotally mounted in a notched wall portion 130 at the tail of the boat, and has unitary with it a propeller 132 which it supports and drives through conventional connecting means 134. The motor is adapted to be swung to carry the propeller up to a raised position through an opening formed in an upwardly sloping bottom wall 136 at the extreme rear end of the boat when the motor is not in use and down through the opening to the position illustrated in FIG. 1 when the motor is in use. It is desirable that the opening be closed by a slide door 126 when the motor is in raised position, so that the entire undersurface of the boat will be streamlined.

A cylinder 92*e* is accordingly connected at its upper, rear end to 136 with sufficient clearance to permit the sliding door 126 to be slid upward and rearward beneath it. A long rod 84*e* extends forward and down from the piston 90*e* and is connected at its free end to upstanding ears 140 which are affixed to the forward margin of the door 126.

Suitable guides and hold-down strips 142 are provided for the sliding door.

The central rear passage 34 is utilized alternatively for the discharge of water when the boat is being driven straight ahead by water picked up from the boat sustaining body of water through passages 26, 28 and 30, and when bilge water transmitted through 46, 48 and 50 is delivered into it.

Ordinarily, it is advantageous to handle water in 34 from these diverse sources one at a time. That is to say, for example, if bilge water pumping is desired, it ought not to be necessary in order to arrive at that setting to go through a sequence of operations induced by the pumping of water through 26, 28 and 30. The passage or discharge line 34 is accordingly made to include a valve box 143 (FIG. 7) in which a flap valve 144 is mounted for rocking movement about the axis of a pivot pin 146, which pin is made fast with the valve. The valve is shown in FIG. 7 in bearing relation with a downwardly facing horizontal seat 145, in which position it completely shuts off ingress of bilge water from the hose 50 while freely admitting water taken in through 26, 28 and 30.

This valve is also indicated in broken lines in a lower position in which it bears against a downwardly sloping seat 148, freely admitting bilge water but shutting off water from 26, 28 and 30. The pivot pin 146 desirably has integral with it a slotted operating crankarm outside the chamber in the box 143 through which the valve is operated by piston rod 84*f*.

I have described what I believe to be the best embodiment of my invention. What I desire to cover by letters patent, however, is set forth in the appended claims.

I claim:

1. The combination with a boat, of power driving means therefor comprising, in combination, a. a single water pump having a pump chamber located, roughly, at least, in the vicinity of the center of mass of the boat and its fixed contents, said pump having a vanel impeller rotatable about a fixed vertical axis and having the vanes thereof slanted always to drive water upward whenever the pump is in operation, said pump having a single casing formed with opposed intake and discharge passages, b. a shell in which the pump casing is mounted for rotation about a generally vertical axis, said shell having numerous divergent passages running toward the front and rear ends of the boat and adapted for selective alignment with the intake and discharge passages of the pump casing, one passage of the pump casing being wide enough to communicate simultaneously with more than one passage of the shell, but the other passage of the pump casing being so narrow that it can communicate with only one passage of the shell at a time, and c. control means for manually rotating the pump casing relative to the shell, the construction and arrangement being such that the operator through operation of said pump, and control of the pump impelled water through manipulation of the casing, has the option of driving the boat directly forward, backward or sidewise without substantial turning of the keel, or of steering the boat by turning the boat to right or left.

2. The combination of claim 1 in which there are a set of several divergent, associated front passages in the front portion of the shell and the same number of associated, divergent individually aligned, passages in the rear portion of the shell, and in which the intake passage of the pump casing is broad enough to communicate simultaneously with all passages of either set but the discharge passage of the pump casing is broad enough to communicate with only one of said passages at a time.

3. The combination of claim 1 in which the shell is additionally formed with a bilge water inlet passage cooperative with a bilge water discharge passage and with the pump, the bilge water inlet passage being so located that the pumping out of bilge water may be effected exclusively whenever it is effected at all.

4. The combination of claim 3 wherein the outlet passage of the pump may be aligned with the bilge water inlet passage when the inlet passage of the pump is aligned with at least one of the rear passages of the shell, so that water may be pumped from the body of water in which the boat is sustained into the bilge water intake passage of the shell, said bilge water intake passage including two spaced valves, each capabale of completely closing off the bilge water intake passage, the construction and arrangement being such that with the valve farther from the pump casing closed and the valve nearer the pump casing open, water may be pumped in to fill the intervening space and then trapped by closing the latter valve, whereby priming of the pump for the pumping of bilge water is assured when the pump casing has been appropriately set for bilge water pumping and the valves are simultaneously opened.

5. The combination of claim 3 in which provision is made of means for delivering pumped bilge water below water level through a shell passage which extends directly rearward so that the discharge of bilge water from such passage will drive the boat directly forward.

6. The combination of claim 5 in which the shell passage referred to as extending directly rearward from the pump is equipped with a valve having an upper position in which reception of bilge water from above is shut off and water from the boat sustaining body of water is admitted horizontally, and a lower position in which the situation is reversed, and remote valve control means is provided, operable by the pilot from his normal station for setting the valve as desired.

7. The combination of claim 1 in which the pump casing includes a fire-fighting discharge passage together with hose means for discharging in a stream water taken in from the body of water in which the boat is floating.

8. The combination of claim 1 in which provision is made at the rear of the boat of an outboard auxiliary motor swingable between a raised, idle position and a depressed active position, the rear end of the boat having an opening through which the unit can be swung, a sliding door for closing said opening when the auxiliary motor unit is in raised, inactive position, and for opening said door to permit location of the auxiliary motor in active position, and remote control means operable from a remote control station to open and close said door.

9. The combination of claim 1 in which several of the shell passages are equipped with control valves, the pump casing control means is located at an operator's station, and a console is provided at the operator's station for selectively opening and closing said valves by remote control.

* * * * *